US005351515A

United States Patent [19]

Astley et al.

[11] Patent Number: 5,351,515

[45] Date of Patent: Oct. 4, 1994

[54] APPARATUS AND METHOD FOR REDUCING THE DIAMETER OF A CYLINDRICAL WORKPIECE

[75] Inventors: Eugene R. Astley, Richland; Charles S. Rutkowski; Jon L. Osborne, both of Kennewick, all of Wash.

[73] Assignee: Sandvik Special Metals Corporation, Kennewick, Wash.

[21] Appl. No.: 73,790

[22] Filed: Jun. 9, 1993

Related U.S. Application Data

[63] Continuation-in-part of Ser. No. 5,967, Jan. 19, 1993, abandoned.

[51] Int. Cl.[5] ..... B21B 21/00

[52] U.S. Cl. ..... 72/126; 72/214

[58] Field of Search ..... 72/97, 126, 208, 209, 72/214

[56] References Cited

U.S. PATENT DOCUMENTS

| | | | |
|---|---|---|---|
| 490,628 | 1/1893 | Heckert | 72/214 |
| 1,219,802 | 3/1917 | Brightman | 72/214 |
| 2,192,808 | 3/1940 | van den Bungelaar | 72/214 |
| 2,387,515 | 10/1945 | Inslee | 72/214 |
| 2,503,464 | 4/1950 | Bannister | 72/214 |
| 2,560,934 | 7/1951 | Coe | 72/214 |
| 2,713,801 | 7/1955 | Singer et al. | 72/214 |
| 2,923,187 | 2/1960 | Bengtsson | 72/214 |
| 3,019,678 | 2/1962 | Fiell | 72/214 |
| 3,260,090 | 7/1966 | Sofranko | 72/126 |
| 3,570,294 | 3/1971 | Shibata | 72/208 |
| 3,600,913 | 8/1971 | van Dorp | 72/208 |
| 3,683,661 | 8/1972 | Bibighaus | 72/214 |
| 4,090,386 | 5/1978 | Naylor et al. | 72/214 |
| 4,233,834 | 11/1980 | Matinlassi | 72/214 |
| 4,562,713 | 1/1986 | Kondoh | 72/214 |
| 4,602,493 | 7/1986 | Dobrucki et al. | 72/126 |
| 4,930,328 | 6/1990 | Duerring | 72/214 |
| 4,955,220 | 9/1990 | Duerring | 72/214 |
| 4,993,251 | 2/1991 | Szendre et al. | 72/214 |

*Primary Examiner*—Lowell A. Larson
*Assistant Examiner*—Thomas C. Schoeffler
*Attorney, Agent, or Firm*—Burns, Doane, Swecker & Mathis

[57] ABSTRACT

A rocker mill includes a pair of roll dies rotatably mounted in a structure and having tapered circumferential grooves for receiving a workpiece. A support is provided for supporting the structure so that it is longitudinally movable relative to the support. The support is rotatably mounted on a frame. A reciprocating driving apparatus is provided for reciprocating the roll dies longitudinally relative to the support through a reduction stroke and a smoothing stroke. A rotating driving apparatus is provided for rotating the roll dies around a longitudinal axis of a workpiece. A method of forming reduced diameter tubing is also described.

44 Claims, 12 Drawing Sheets

APPARATUS AND METHOD FOR REDUCING THE DIAMETER OF A CYLINDRICAL WORKPIECE

This application is a continuation-in-part of U.S. patent application Ser. No. 08/005,967, filed Jan. 19, 1993, now abandoned.

BACKGROUND AND SUMMARY OF THE INVENTION

The present invention relates to precision rocker mills and, more particularly, to precision rocker mills of the type which produce tubes from hollow metal workpieces.

Rocker mills of the type known in the art are disclosed, for example, in U.S. Pat. Nos. 4,562,713 to Kondoh and 4,930,328 to Duerring et al. Such mills typically include a movable rollstand which is longitudinally reciprocated along a hollow workpiece. The rollstand includes a pair of grooved roll dies which define a nip through which the workpiece is passed so as to be radially compressed. A mandrel is disposed within the workpiece to radially support the inside of the workpiece. The workpiece is progressively advanced and rotated at selected times.

The grooves of the roll dies are of progressively narrowing width in the circumferential direction. The grooves typically extend around the entire circumference of the roll die. A relief pocket is formed in the grooves and defines a transition from a smaller portion to a larger portion. The relief pocket is provided to facilitate reversing the direction of rotation of the roll dies and advancing and rotating the workpiece. Thus, by rotating the roll dies so that points on the periphery of the dies are displaced through the angle defined by the groove as the rollstand moves longitudinally along the workpiece, the workpiece is subjected to a progressively increasing radial compression in the nip between the dies and the diameter of the workpiece is progressively reduced.

During a workpiece reduction stroke of each cycle of the rolling operation, the roll dies are rotated such that the narrowest portion of the grooves define the nip. At the final portion of the reduction stroke, the workpiece is usually positioned between the dies in a nip defined by the relief pocket. After the roll dies reach the end of the reduction stroke, the roll dies are rotated in an opposite direction in a smoothing stroke of the cycle of the rolling operation. During the smoothing stroke, the nip defined by the grooves becomes larger and the surfaces of the grooves are moved away from the reduced diameter workpiece. At the end of the smoothing stroke, the workpiece is again usually positioned between the dies in a nip defined by the relief portion and the workpiece is advanced a predetermined distance and is rotated axially through a predetermined angle.

During the reduction stroke, the workpiece tends to be deformed by the roll dies into the shape of an ellipse having a major axis along the nip between the roll dies. The workpiece is rotated prior to the smoothing stroke so that the cumulative effect of numerous deformations of the workpiece is to form a substantially circular workpiece. If the workpiece is not rotated, the effect of the rolling operation is typically to form a finned tubular product. It is preferred that the angle of rotation of the workpiece not be divisible into 360° without a remainder, and the angle of rotation is generally between 35° and 70°.

Rotation of the workpiece is typically accomplished by one or more workpiece turners. Turners generally include a clamp which grips the exterior of the workpiece at some point before or after the path of travel of the roll dies. Types of turners typically used in conventional rocker mills include feed carriage turners and inlet turners for turning the workpiece as it is fed between the rollers. An exit turner is generally provided for turning the workpiece after it has been reduced in diameter and its trailing end has come out of contact with the inlet turner. A mandrel turner is provided for turning the mandrel that is disposed inside the workpiece when the workpiece is turned.

When rocker mills are operating on tubing such as thin-walled tubing and small diameter tubing, the use of turners often causes damage to the tubing, such as where the tubing is gripped too tightly and the tubing walls are bent far punctured or the tube is twisted. Conventional rocker mills using one or more workpiece turners have various disadvantages. For example, complex equipment is necessary to synchronize multiple turners. Further, when it is desired to change the size of the workpiece and the product, it is necessary to change the jaw size on all of the turners. Further still, the need to turn the workpiece at the end of the reduction or smoothing stroke slows down the operation of the rocker mill, as it generally takes substantially longer to turn the workpiece than it does to incrementally advance it. Other disadvantages in the use of a rocker mill in which a workpiece is turned arise during the use of the rocker mill in association with other workpiece handling equipment, such as product coilers. For example, if it is desired to coil a product, the coiler must be rotated as the workpiece is rotated so that the product does not become twisted.

It is desirable, therefore, to provide a rocker mill in which the need for turners is obviated while still producing a substantially circular reduced product.

The present invention, generally speaking, obviates the need for workpiece and mandrel turners in an apparatus and method for reducing the diameter of a cylindrical workpiece.

In accordance with one aspect of the present invention, a rocker mill for reducing the diameter of a cylindrical workpiece is provided. The rocker mill includes a frame and an assembly including means for supporting a pair of roll dies rotatably about their axes. The roll dies have tapered circumferential grooves defining a nip for receiving a workpiece. Means for supporting the assembly relative to the frame are provided. The assembly supporting means permit the assembly to rotate about the longitudinal axis of the workpiece and permit the assembly to move longitudinally relative to the frame. Means are provided for longitudinally reciprocating the assembly including the roll dies relative to the frame through a predetermined distance through a reduction stroke and a smoothing stroke. Intermittent rotating means are provided for rotating the roll dies around the longitudinal axis of the workpiece such that rotation occurs through a predetermined angle.

In accordance with another aspect of the present invention, a method for reducing the diameter of a cylindrical workpiece is described. In the method, a workpiece is fed between a pair of roll dies having tapered circumferential grooves defining a nip for receiving the workpiece. The roll dies are longitudinally reciprocated relative to the workpiece through a predetermined longitudinal distance through a reduction stroke and a smoothing stroke such that the roll dies rotate about roll die axes. The roll dies are intermittently rotated around the longitudinal axis of the workpiece such that rotation occurs through a predetermined angle.

In accordance with yet another aspect of the present invention, a rotatable rollstand assembly for a rocker mill is described. The rotatable rollstand assembly includes a die assembly including axle means for rotatably supporting a pair of roll dies having tapered circumferential grooves defining a nip for receiving a workpiece and a pair of gears. Means, including a rack assembly, are provided for supporting the die assembly relative to a pair of racks for engaging with the pair of gears such that longitudinal movement of the die assembly relative to the racks causes the roll dies to rotate in opposite directions. At least portions of the supporting means are adapted to be rotatably mounted such that rotation of the supporting means causes rotation of the roll dies about a longitudinal axis passing through the nip.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DESCRIPTION OF THE PREFERRED EMBODIMENT

Figure 1:
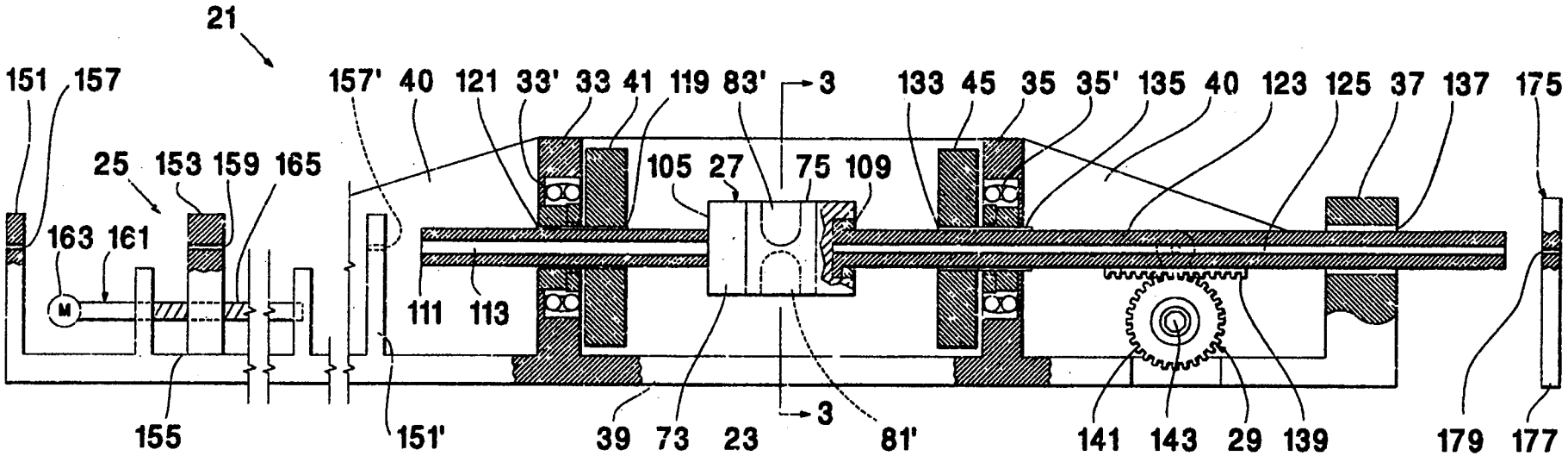
FIG. 1 is a side, partial cross sectional, schematic view of a rocker mill according to an embodiment of the present invention.
Figure 2:
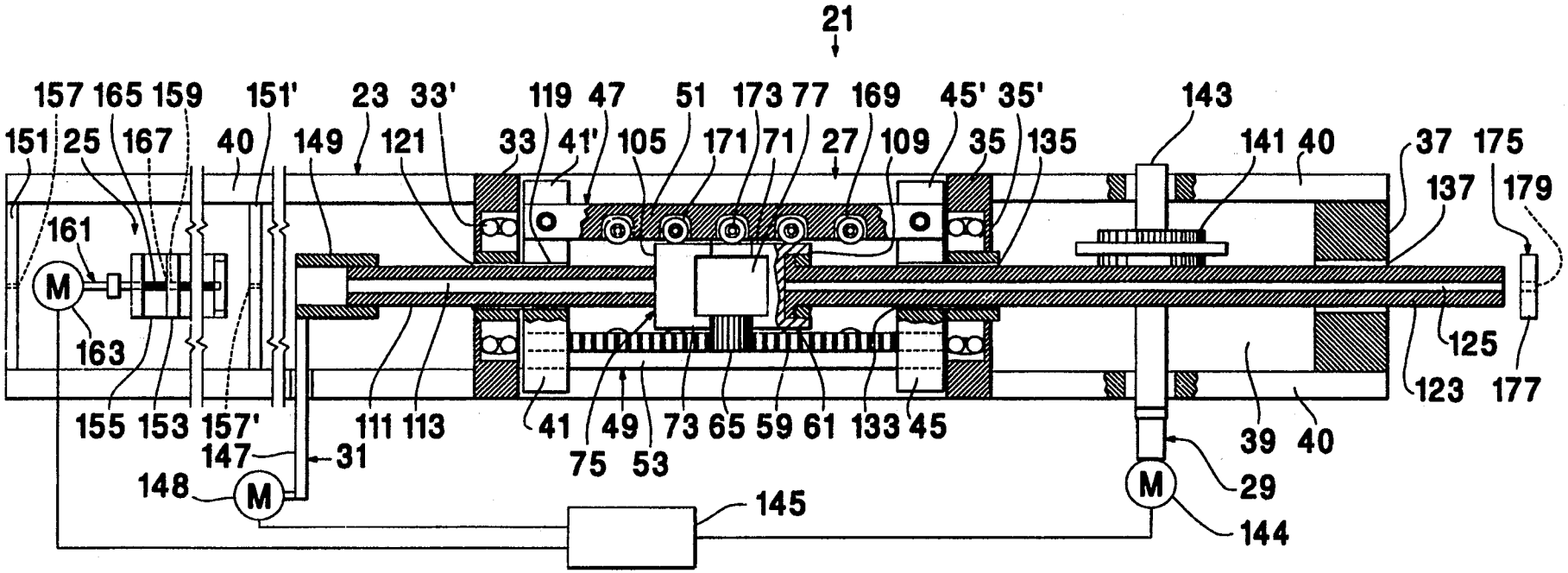
FIG. 2 is a top, partial cross sectional, schematic view of the rocker mill of FIG. 1.

A side, partial cross-sectional view of a rocker mill 21 is shown in FIG. 1, and a top view of the rocker mill is shown in FIG. 2. The rocker mill 21 includes a frame assembly 23, a feed carriage assembly 25 mounted on the frame assembly for feeding a cylindrical workpiece W, shown in FIG. 6, the workpiece usually being a small diameter tube or shaft, and, for applications involving the reduction of diameter of a tubular workpiece, a mandrel (not shown). The rocker mill 21 further includes a rollstand assembly 27 supported on the frame assembly for reducing the diameter of the workpiece. Portions of the rollstand assembly 27 are longitudinally movable relative to the frame assembly 23 and portions of the rollstand assembly are axially rotatable relative to the frame assembly. The longitudinally movable portions of the rollstand assembly 27 are longitudinally reciprocated relative to the frame assembly 23 with a reciprocating drive apparatus 29, which is preferably mounted on the frame assembly. The axially rotatable portions of the rollstand assembly 27 are intermittently rotated relative to the frame assembly 23 with a rotating drive apparatus 31, seen in FIG. 2, which is preferably mounted on the frame assembly.

The rollstand assembly 27 is supported relative to the frame assembly 23 by portions of the frame assembly including a forward block 33, a rear block 35, and an end block 37, all of which are mounted on a base plate 39 of the frame assembly. The forward and rear blocks 33, 35 are preferably braced relative to the base plate 39 by gussets 40 at edges of the forward and rear blocks. The rollstand assembly 27 includes a substantially circular forward end plate 41 rotatably mounted on and disposed next to the forward block 33 in an area defined by the forward block and the rear block 35, and a substantially circular rear end plate 45 rotatably mounted on and disposed next to the rear block 35 in the area defined by the forward block and the rear block.

Figure 3:
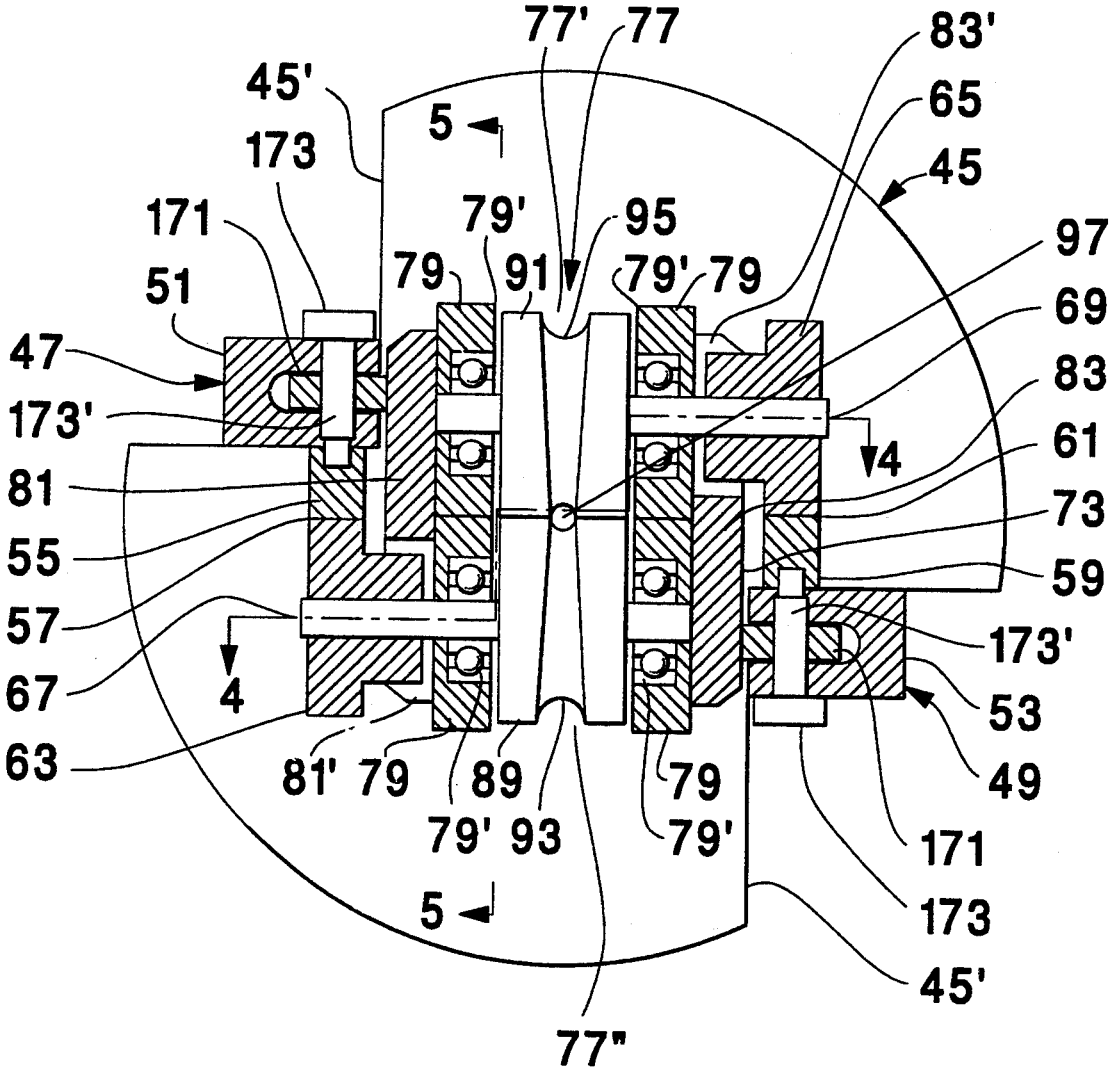
FIG. 3 is a partial cross-sectional, schematic view of a portion of the rocker mill of FIG. 1 taken at section 3—3.

As seen in FIG. 3, the rear end plate 45 is formed with a pair of opposing wedge-shaped cutout areas 45'. The forward end plate 41 is essentially a mirror image of the rear end plate 45. As seen in FIG. 2, the forward and rear end plate 41, 45 are linked to one another by first and second rack assemblies 47, 49. The first and second rack assemblies 47, 49 include first and second rack supports 51, 53, respectively, that are fastened, at their first and second ends, to the edges of the forward and rear end plates 41, 45, in the cutout areas 41', 45' of the end plates. As seen in FIG. 3, a first rack 55 with a toothed face 57 is fastened to a side of the first rack support 51 so that the toothed face faces a toothed face 61 of a second rack 59 that is fastened to a side of the second rack support 53.

The first and second racks 55, 59 engage with left and right pinion gears 63, 65, respectively. The left and right pinion gears 63, 65 are fixed to first and second arbors or axles 67, 69, respectively, which extend from left and right sides 71, 73, respectively, of a rollstand sled 75. Points on the pitch circles of the left and fight pinion gears 63, 65 lie in the same planes as the pitch lines of the two racks 55, 59 for engagement therewith. The rollstand sled 75 is formed with an interior opening 77, seen in FIGS. 2, 3, and 4, extending vertically from the top to the bottom of the rollstand sled.

Figure 4:
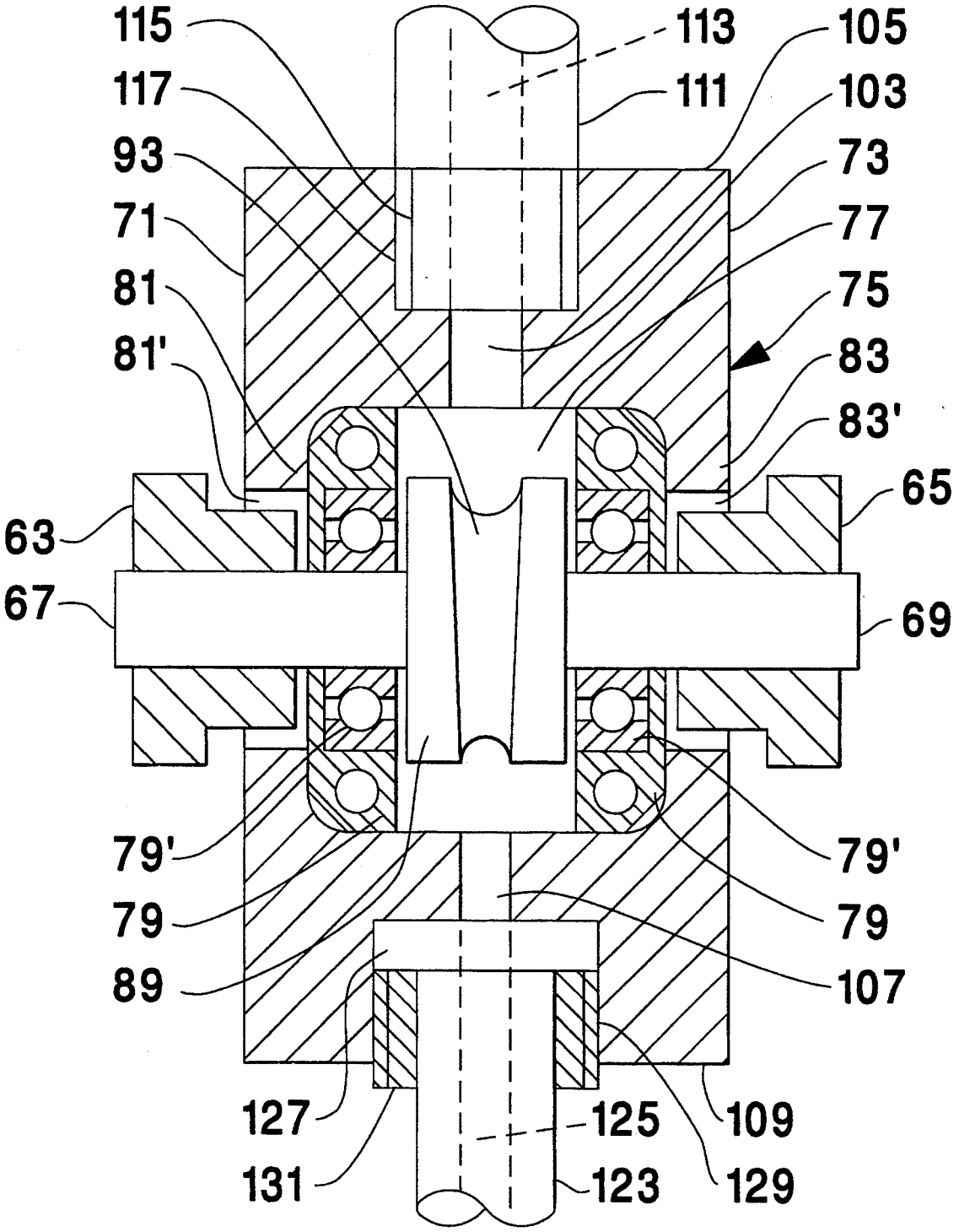
FIG. 4 is a partial cross-sectional, schematic view of a portion of the portion of the rocker mill of FIG. 3 taken at section 4—4.
Figure 5:
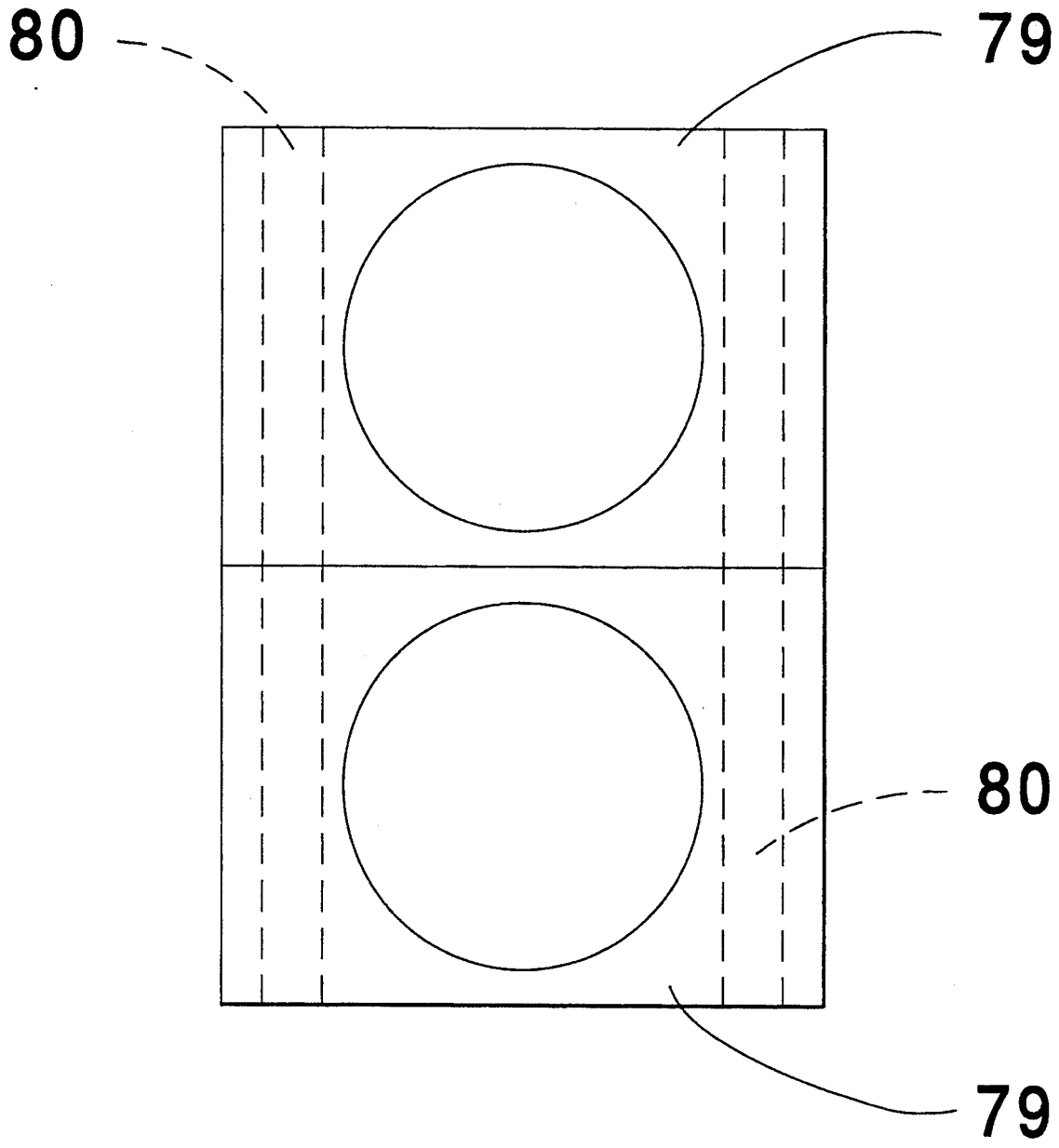
FIG. 5 is a schematic view of a portion of the portion of the rocker mill of FIG. 3 taken at section 5—5.

Two bearing housings 79 are inserted through a top opening 77' or a bottom opening 77'' of the rollstand housing 75 into the interior opening 77 and are disposed adjacent to a left wall 81 of the interior opening, one above the other as seen in FIG. 5, and two bearing housings are disposed adjacent to a right wall 83 of the interior opening, one above the other. The first axle 67 extends through a slot 81', seen in FIGS. 1, 3, and 4, in the left side 71 of the rollstand sled 75 and is rotatably mounted relative to the rollstand sled in bearings 79' in two lower ones of the bearing housings 79. The second axle 69 extends through a slot 83' in the right side 73 of the rollstand sled 75 and is rotatably mounted relative to the rollstand sled in bearings 79' in two upper ones of the bearing housings 79.

Figure 6:
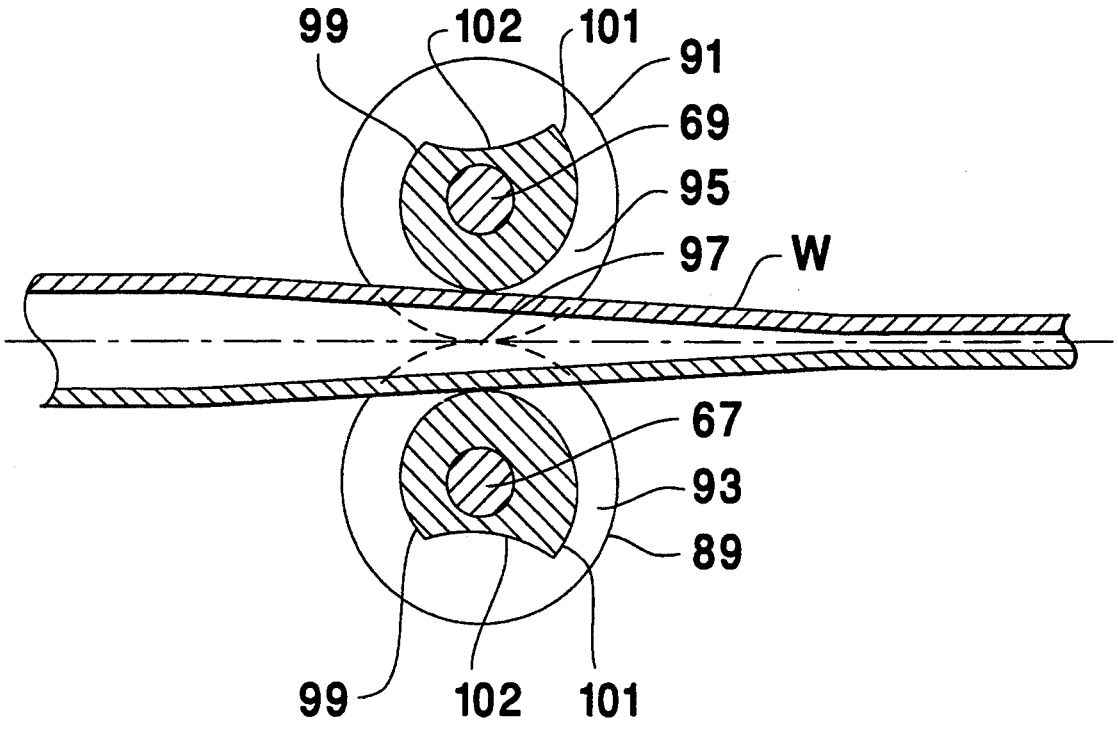
FIG. 6 is a cross-sectional, side schematic view of a pair of roll dies according to an embodiment of the present invention.

As seen in FIGS. 3, 4, and 6, the first and second roll dies 89, 91 are fixedly mounted on the first and second axles 67, 69, respectively, and are slightly larger in diameter than the pitch circles of the left and right pinion gears 63, 65. As seen in FIGS. 3 and 6, the first and second roll dies 89, 91 are disposed in the interior opening 77 of the rollstand sled 75 such that the outer peripheries of the first and second roll dies abut one another. The first and second roll dies 89, 91 may be formed as one piece with the first and second axles 67, 69. The first and second roll dies 89, 91 are formed with tapered circumferential grooves 93, 95 which define a nip area 97 through which a workpiece passes. The first arm second roll dies 89, 91 are oriented relative to one another such that identically sized portions of the tapered grooves 93, 95 oppose one another.

In a preferred method of assembling the rollstand assembly 27, the roll dies 89, 91, the beatings 79' and the beating housings 79, and the left and right pinion gears 63, 65 are positioned on the axles 67, 69 first. The roll die 89 is then inserted through the bottom opening 77'' of the rollstand sled such that die first axle slides into the slot 81', and the roll die 91 is inserted through the top opening 77'' of the rollstand sled such that the second axle slides into the slot 83'. The bearing housings 79 are then bolted together with bolts (not shown) extending through bores 80 in the bearing housings, seen in FIG. 5.

As seen in FIGS. 2 and 3, the first and second rack supports 51, 53 are preferably also formed, in sides thereof, with a series of recessed areas 169 at 90° to the sides on which the first and second racks 55, 59 are fastened. Bearing wheels 171 are rotatably mounted in the recessed areas 169 such that portions of the wheels extend slightly out of the recessed area. The bearing wheels 171 are preferably mounted in the recessed areas 169 with screws 173 which also serve to fasten the first and second racks 55, 59 to the first and second rack supports 51, 53. The bearing wheels 171 abut the left and right sides 71, 73 of the rollstand sled 75 to facilitate maintaining movement of the rollstand sled in a straight line during longitudinal movement of the sled. As seen with reference to FIG. 3, the bearing wheels 171 facilitate avoiding counter-clockwise rotation of the rollstand sled 75 relative to the first and second rack assemblies 47, 49. The racks 55, 59 abut against the pinion gears 63, 65 and facilitate avoiding clockwise rotation of the rollstand sled 75 relative to the first and second rack assemblies 47, 49. Portions 173' of the screws 173 are preferably cammed (not shown) to facilitate adjustment of the position of the bearing wheels 171 relative to the rollstand sled 75.

As seen with reference to FIGS. 2, 3, and 6, as the rollstand sled 75 is moved longitudinally relative to the first and second rack assemblies 47, 49 with the teeth 57, 61 of the first and second racks 55, 59 engaging with the left and right pinion gears 63, 65, the first and second roll dies 89, 91 are rotated so that identically sized portions of the tapered grooves 93, 95 always oppose one another. As the rollstand sled 75 is moved longitudinally relative to the first and second rack assemblies 47, 49 toward the forward end plate 41, the first roll die 89 is rotated clockwise and the second roll die 91 is rotated counterclockwise so that the opposing tapered grooves 93, 95 define a progressively larger nip 97 until after points 99 at the largest working part of the tapered grooves oppose one another and relief pockets or transition areas 102, usually larger than the points defining the largest working part of the grooves, oppose one another. As the rollstand sled 75 is moved longitudinally relative to the first and second rack assemblies 47, 49 toward the rear end plate 45, the first roll die 89 is rotated counterclockwise and the second roll die 91 is rotated clockwise so that the opposing tapered grooves 93, 95 define a progressively smaller nip 97, until after points 101 at the smallest part of the tapered grooves oppose one another and the relief pockets or transition areas 102 oppose one another. When a workpiece is positioned in the nip 97 and the rollstand sled 75 is moved longitudinally relative to the first and second rack assemblies toward the rear end plate 45, the diameter of the workpiece is reduced in the progressively smaller nip.

Ordinarily, the tapered grooves 93, 95 extend around substantially the entire circumference of the first and second roll dies 89, 91, such that, as seen in FIG. 6, the points 99 at the largest working portions of the grooves are separated from the small ends 101 of the grooves by the relief pockets or transition portions 102 of the grooves. The relief pockets or transition areas 102 generally extend through an angle of between 65° and 110° and facilitate reversing the direction of the roll dies 89, 91, rotating the roll dies about the longitudinal axis of the workpiece, and advancing the workpiece at the end of the reduction and smoothing strokes, as the nip 97 defined by the relief pockets or transition areas is larger than the workpiece. The relief pockets or transition areas 102 further serve to prevent contact of the small end 101 of the grooves 93, 95 with the workpiece at the end of the smoothing stroke. It is also well known to form grooves having extended straight lengths (not shown), usually at the small end of the groove, to facilitate workpiece smoothing.

The rollstand sled 75 is usually moved longitudinally relative to the first and second rack assemblies 47, 49 by the reciprocating drive apparatus 29 through a distance approximately equal to that portion of an arc on the circumference of the dies 89, 91 defined by the tapered grooves 93, 95, which, as noted above, is normally equal to the circumference of the roll dies. Near the forward-most point in the movement of the rollstand sled 75 relative to the first and second rack assemblies 47, 49, when the rollstand sled is close to the forward end plate 41, the nip 97 attains its largest working size. Near the rear-most point in the movement of the rollstand sled 75 relative to the first and second rack assemblies, substantially when the rollstand sled is closest to the rear end plate 45, the nip attains its smallest size. As will be explained further below, it is desirable to permit the rollstand sled 75 to move toward the front and rear end plates 41, 45 such that the tapered grooves 93, 95 turn past the points 99, 101 at which they define the largest working and smallest nips 97 so that the relief pocket or transition portions 102 of the grooves oppose one another, and the workpiece is not in contact with the nip.

As seen in FIG. 4, the rollstand sled 75 is formed with an entry opening 103 at a forward end 105 of the rollstand sled to permit a workpiece to extend into the rollstand sled and into the nip 97. The rollstand sled 75 is also formed with an outlet opening 107 at a rear end 109 of the rollstand sled to permit the reduced diameter product to extend from the nip 97 out of the rollstand sled. The entry opening 103, the nip 97, and the outlet opening 107 are axially aligned.

As seen in FIGS. 1 and 4, a guide shaft 111 having an axial bore 113 is attached to the forward end 105 of the rollstand sled 75. As seen in FIG. 4, the guide shaft 111 is attached such that the axial bore 113 is axially aligned with the entry opening 103. A workpiece is pushed by the feed carriage assembly 25 into the axial bore 113 so that it is fed into the entry opening 103 and to the nip 97, as is explained further below. The guide shaft 111 is preferably formed with an externally threaded end 115 that is screwed into an internally threaded bore 117 in the forward end 105 of the rollstand sled 75. Upon attachment of the guide shaft 111 to the rollstand sled 75, the guide shaft is substantially prevented from movement relative to the rollstand sled.

Figure 7:
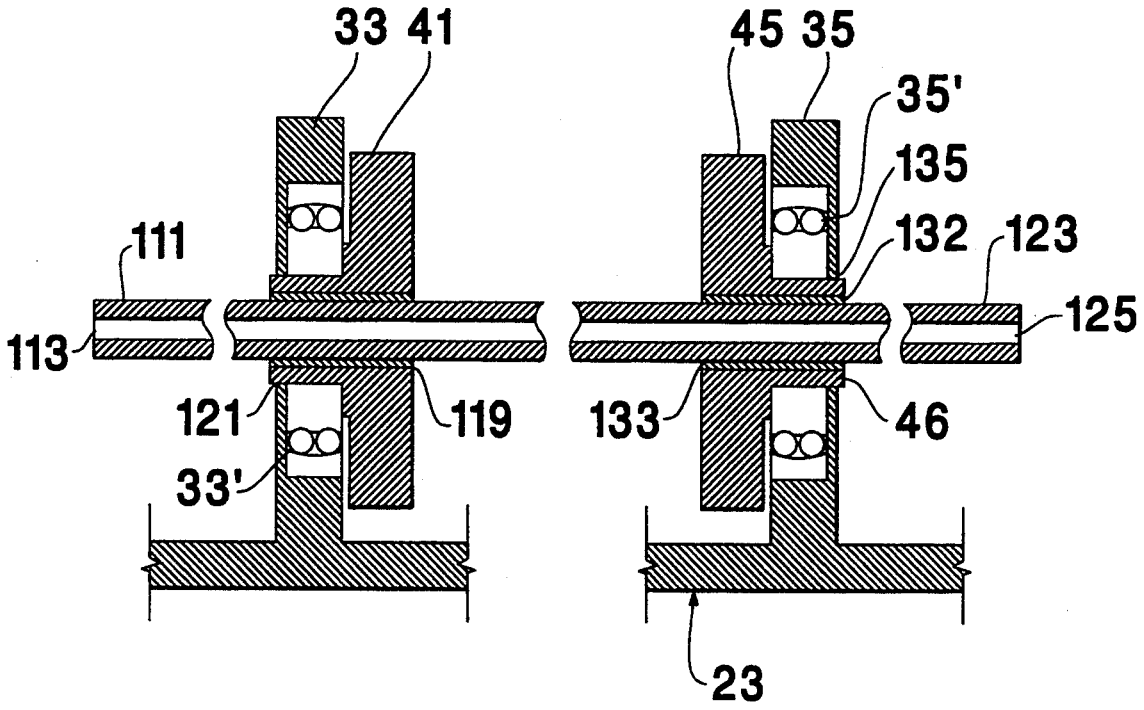
FIG. 7 is a cross-sectional, side schematic view of a portion of a rocker mill according to an embodiment of the present invention.

As seen in FIG. 7, the guide shaft 111 extends through a bushing 118 non-rotatably fitted in a central opening 119 formed in the forward end plate 41. A portion 42 of the forward end plate 41 is disposed in an opening 121 formed in the forward block 33. The portion 42 of the forward end plate 41, the bushing 118, and the guide shaft 111 facilitate supporting the rollstand assembly 27 relative to the frame 23. The guide shaft 111 further facilitates inflexibly guiding a workpiece into the entry opening 103, seen in FIG. 4. The guide shaft 111 is axially rotatable and longitudinally slidable relative to the forward block 33 and the forward end plate 41 in the bushing 118. The forward block 33 is preferably provided with a bearing 33' disposed in the opening 121 for facilitating axial rotation of the portion 42. As seen in FIG. 2, the rotating drive apparatus 31 is preferably coupled to the guide shaft 111 so that the rotating portions of the rollstand assembly 27 are intermittently rotated relative to the frame assembly 23 and the workpiece, as will be described in more detail below.

As seen in FIGS. 1 and 4, a con rod 123 having an axial bore 125 is attached to the rear end 109 of the rollstand sled 75, preferably such that it is axially rotatable relative to the rollstand sled. As seen in FIG. 4, the con rod 123 is attached to the rollstand sled 75 such that the axial bore 125 is axially aligned with the outlet opening 107. The reduced diameter workpiece exits the rollstand sled 75 through the outlet opening 107 and is advanced through the axial bore 125, as is explained further below. The con rod 123 is formed with a flanged end 127 that is fitted into an internally threaded bore 129 in the rear end 109 of the rollstand sled 75. An externally threaded pivot nut 131 fits around the con rod 123 and is screwed into the internally threaded bore 129 so that the con rod is rotatably attached to the rollstand sled 75 so that the rollstand is rotatable when the con rod is not axially rotated.

As seen in FIG. 7, the con rod 123 extends through a bushing 132 non-rotatably fitted in a central opening 133 formed in the rear end plate 45. A portion 46 of the rear end plate 45 is disposed in an opening 135 formed in the rear block 35. The con rod 123 extends through the bushing 132, and an opening 137 in the end block 37, seen in FIGS. 1 and 2, and is longitudinally slidable relative to the bushing and the rear end plate, the rear block, and the end block. The rear block 35 is preferably provided with beatings 35' disposed in the opening 135 for facilitating axial rotation of the rear end plate 45.

The con rod 123, the bushing 132, and the portion 46 of the rear end plate 45 facilitate supporting the rollstand assembly 27 relative to the frame assembly 23. The con rod also facilitates inflexibly guiding a reduced diameter workpiece from the outlet opening 107, seen in FIG. 4. As seen in FIGS. 1 and 2, the reciprocating drive apparatus 29 is coupled to the con rod so that the longitudinally movable portions of the rollstand assembly 27 are reciprocated relative to the frame 23 and the workpiece, as will be described in more detail below.

As seen in FIG. 1, and in accordance with a presently preferred embodiment, the reciprocating drive apparatus 29 includes a rack 139 attached to the con rod 123 and a gear 141, which meshes with the rack, fixed to a shaft 143 that is rotatably mounted on the frame assembly 23. The gear 141 is rotated by a driver 144, such as a crank arm assembly or a rotary actuator, such that the gear turns first in one direction and then in the opposite direction. The con rod 123 is preferably prevented from axial rotation, however, the rack 139 may be provided with teeth disposed around the entire periphery of the con rod so that axial rotation of the con rod does not affect the ability of the reciprocating drive apparatus 29 to reciprocate the rollstand assembly 27. Means are preferably provided for preventing rotation of the con rod 123 relative to the gear 141, such as, for example, a longitudinal groove (not shown) formed on the exterior of the con rod and a pin (not shown) disposed inside the opening 137 of the end block 37 so that the pin fits within the groove and rotation of the con rod is prevented. Ordinarily, however, the rack 139 and the gear 141 are of sufficient width that they serve to prevent rotation of the con rod 123.

The alternating rotational direction of the gear 141 moves the rack 139 in alternating longitudinal directions so that the con rod 123, the rollstand sled 75 and the components mounted therein, and the guide shaft 111 are reciprocated relative to the frame assembly 23, the first and second rack assemblies 47, 49, and the forward and rear end plates 41, 45. As noted above, the rollstand sled 75 and other longitudinally movable portions of the rollstand assembly 27 normally reciprocatingly move a distance approximately equal to the length of the tapered grooves 93, 95, which is generally equal to the circumference of the roll dies 89, 91. Accordingly, the gear 141 is rotated so that the distance through which the longitudinally movable portions of the rollstand assembly 27 reciprocate is approximately equal to the length of the tapered grooves 93, 95.

In practice, as noted above, and as explained further below, the longitudinally movable portions of the rollstand assembly 27 are preferably adapted to be moved so that, when the longitudinally movable portions of the rollstand assembly are nearest the forward end plate 41, the roll dies 89, 91 are oriented such that the nip 97 is defined by the points 102 on the tapered grooves 93, 95 defining the relief pocket or transition portion, having just passed the points 99 on the tapered grooves defining the largest working portion of the grooves. It is preferred that the diameter of the largest working nip 97, corresponding to the nip defined when the points 99 oppose one another, be approximately the same as the diameter of the workpiece being fed. Further, when the longitudinally movable portions of the rollstand assembly 27 are nearest the rear end plate 45, the nip 97 is again defined by the points on the tapered grooves 93, 95 along the relief pocket or transition portion 102, the roll dies 89, 91 having just been turned past the points 101 on the tapered grooves defining the smallest nip. In addition to the foregoing preferred embodiment, of course, other means for reciprocating the roll dies 89, 91 along a workpiece are well known, such as using a linear induction motor.

The rotatable portions of the rollstand assembly 27, including the guide shaft 111, the rollstand sled 75 and the parts mounted therein, the forward and rear end plates 41, 45, and the first and second rack assemblies 47, 49 are preferably rotated about the longitudinal axis of the workpiece by the rotating drive apparatus 31 when the nip 97 is larger than the workpiece in the nip. This generally occurs when the relief pockets or transition area 102 of the tapered grooves 93, 95 define the nip 97, when the rollstand sled 75 is closest to the forward end plate 41 or the rear end plate 45. The rotating drive apparatus 31 is preferably adapted to rotate the rotating portions of the rollstand assembly 27 at the end of the smoothing stroke, at the end of the reduction stroke, or at the end of the smoothing stroke and the end of the reduction stroke. The rotating drive apparatus 31 may also be adapted to rotate the rotating portions of the rollstand assembly 27 during some brief portions of the reduction and smoothing strokes when the workpiece is not in contact with the grooves 93, 95 in the roll dies 89, 91, i.e., when the nip 97 is still defined by the opposing relief pockets or transition areas 102.

The rotating drive apparatus 31 preferably rotates the guide shaft 111 through a predetermined angle which, in turn, causes the rotatable portions of the rollstand assembly 27 to rotate. The guide shaft 111 is, as noted above, attached to the rollstand sled 75 so that it is prevented from movement relative to the rollstand sled. The guide shaft 111 is also, as noted above, longitudinally slidable relative to the forward end plate 41 in the bushing 118. As noted above, however, the rollstand sled 75 is prevented from rotation relative to the first and second rack assemblies 47, 49 by virtue of the beating wheels 171 on the first and second rack supports 51, 53 which, as seen in FIG. 3, prevent counter-clockwise rotation by contacting the rollstand sled 75, and by virtue of the racks 55, 59 which prevent clockwise rotation as they engage with the first and second pinion gears 63, 65. Rotation of the guide shaft 111 therefore causes the forward end plate 41, the first and second rack assemblies 47, 49, the rear end plate 45, and the rollstand sled 75 and parts mounted therein to rotate.

The rocker mill 21 is preferably provided with means 145 such as a gear box or an electronic control system synchronized with the reciprocating drive apparatus 29 so that the rotating drive apparatus 31 rotates the rotating portions of the rollstand assembly 27 at appropriate points during the reciprocation of the rollstand assembly. In a presently preferred embodiment, seen in FIG. 2, the rotating drive apparatus 31 includes a drive 147 such as a gear, rack, belt, or chain drive, driven by a motor 148, that engages a gear, pulley, or sprocket 149 fixed on the guide shaft 111. The gear, pulley, or sprocket 149 is keyed to the guide shaft ill so that the gear, pulley, or sprocket is adapted to slide longitudinally, but not rotationally, relative to the guide shaft and so that the drive 147 is not damaged as the guide shaft is longitudinally reciprocated. The rotating drive apparatus 31 may, however, include any number of means for rotating the rotating portions of the rollstand assembly 27, such as fixing an annular rotor of a servomotor to one of the forward or rear end plates 41, 45, which attain the desired end of rotating the roll dies 89, 91 around a workpiece at desired times.

The rotating drive apparatus 31 is adapted to rotate the rotating portions of the rollstand assembly 27 through one or more predetermined angles, preferably angles between 35° and 70° degrees. The rotating drive apparatus 31 is preferably also adapted to rotate the rotating portions of the rollstand assembly 27 both in a clockwise and a counterclockwise direction, so that the rotating drive apparatus rotates the rotating portions of the rollstand assembly first through one or more predetermined angles in one direction, and then through one or more predetermined angles in the opposite direction.

One or more stationary mandrel clamps 151, 151' for supporting a mandrel (not shown) in the workpiece are mounted on the frame 23. The mandrel has an outer diameter slightly smaller than the inner diameter of the workpiece prior to arrival at the rollstand sled 75, and tapers down to an outer diameter approximately the same size as the inner diameter of the workpiece after reduction. The feed carriage assembly 25 includes a "hollow" or workpiece clamp 153 slidingly mounted on a slide assembly 155 for longitudinal movement relative to the frame 23.

The mandrel clamps 151, 151' are formed with bores 157, 157' and the workpiece clamp 153 is provided with a bore 159. The bores 157, 157', 159 are axially aligned with the axial bore 113 of the guide shaft 111, the nip 97 in the rollstand sled 75, and the axial bore 125 of the con rod 123 so that the mandrel and the workpiece are axially aligned with the longitudinal axis. Means such as cap screws or automatic, air actuated clamps (not shown) are provided for holding the mandrel stationary in the bores 157, 157' of the mandrel clamps 151, 151' and for holding the workpiece stationary in the bore 159 of the workpiece clamp.

The feed carriage assembly 25 includes a workpiece clamp drive assembly 161 for moving the workpiece clamp 153 toward the guide shaft 111, for advancing workpieces into the axial bore 113 of the guide shaft, through the nip 97 in the rollstand sled 75, and out the axial bore 125 of the con rod, and for returning the workpiece clamp 153 to a starting position in which a new workpiece is loaded into the workpiece clamp. Ordinarily, multiple workpieces are disposed, one after another, in the bore 159 of the workpiece clamp 153, the axial bore 113 of the guide shaft 111, the rollstand sled 75, and the axial bore 125 of the con rod 123 so that as the workpiece clamp drive assembly 161 advances the workpiece clamp 153 in which a trailing workpiece is held, the trailing workpiece pushes the rear end of an earlier workpiece, etc.

The workpiece clamp drive assembly 161 preferably includes a driver such as a motor 163 for intermittently turning a worm gear 165 rotatably mounted on the slide assembly 155 so that it turns clockwise or counterclockwise relative to the slide assembly. The worm gear 165 extends through a threaded bore 167 in the workpiece clamp 153 so that, as the worm gear is rotated several turns or a portion of a turn in one direction, the workpiece clamp is incrementally advanced and, as the worm gear is rotated in the opposite direction, the workpiece clamp is returned. The workpiece clamp drive assembly 161 is preferably adapted to return or incrementally advance a workpiece at the end of the reduction stroke, at the end of the smoothing stroke, at the end of both the reduction stroke and the smoothing stroke, or at any time that the nip 97 formed by the grooves 93, 95 of the roll dies 89, 91 is not in contact with the workpiece. The workpiece clamp drive assembly 161 is preferably synchronized with synchronizing means 145 such as a gear box or an electronic control system for controlling the motor 163 so that it rotates the worm gear 165 only at the appropriate times.

Workpiece advancing mechanisms of the type suitable for use with the rocker mill 21 of the present invention are known in the art. One such mechanism is described in U.S. Pat. No. 4,955,220, which is incorporated by reference to the extent that it discloses such a mechanism.

A workpiece that is advanced along the opening 113 in the guide shaft 111, through the nip 97, and along the opening 125 in the con rod 123 such that it is no longer held in the bore 159 in the workpiece clamp 153 preferably extends partially out of the end of the con rod and is clamped by means 175 for holding the workpiece so that it does not rotate when the rotating portions of the rollstand assembly 27 rotate and the trailing end of the workpiece is still in the nip. The holding means 175 permits the reduced diameter workpieces to exit the opening in the con rod 123 and are preferably in the form of a stand 177 formed with a bore 179 sized such that there is sufficient friction between the walls of the bore and the workpiece to prevent rotation of the workpiece while allowing longitudinal movement of the workpiece.

A preferred mode of operation of the rocker mill 21 according to the present invention will now be described. With reference to the rocker mill 21 shown in FIGS. 1 and 2, the rollstand sled 75 is moved to a position defining the beginning of the reduction stroke in which the rollstand sled is at the point at which it is closest to the forward end plate 41 and the relief pockets or transition areas 102 on the grooves 93, 95 of the roll dies 89, 91 define the nip 97. The mandrel in the bore 157 of a forward-most mandrel clamp 151 is unclamped and a workpiece (not shown) is slid over the mandrel while the mandrel is held stationary in the bore 157' of the other mandrel clamp 151' disposed near the forward block 33. When the workpiece is slid over the mandrel to a point when the mandrel is able to be clamped by the forward-most mandrel clamp 151, the mandrel clamp 151, near the forward block 33 is unclamped so that the workpiece slides through its bore 157' over the mandrel. The workpiece is extended through the axial bore 113 of the guide shaft 111 and into the nip 97 in the rollstand sled 75 to a point near the forward end plate 41 and is clamped in the bore 159 of the workpiece clamp. The mandrel extends through the interior diameter of the workpiece, past the end of the workpiece, to a point near the rear end plate 45.

The reciprocating drive apparatus 29 causes the longitudinally movable parts of the rollstand assembly 27, i.e., the guide shaft 111, the rollstand sled 75, and the con rod 123 to move in a reduction stroke such that the rollstand sled moves toward the second end plate 45. As seen, for example, in FIG. 6, during the reduction stroke, the nip 97 becomes progressively smaller until the points 101 at the smallest part of the tapered grooves 93, 95 of the roll dies 89, 91 oppose one another and the diameter of the workpiece is reduced around the mandrel, which supports the interior walls of the workpiece. The reduction stroke then continues until after the points 101 oppose one another, and the end of the reduction stroke is defined when the relief pocket or transition portions 102 of the grooves oppose one another.

At the end of the reduction stroke, the workpiece is incrementally advanced a predetermined distance by the feed carriage assembly 25. At substantially the same time, the rotating portions of the rollstand assembly 27, i.e., the guide shaft 111, the rollstand housing 75, the forward and rear end plates 41, 45, and the first and second rack assemblies 47, 49 are rotated around the workpiece through a first predetermined angle by the rotating drive apparatus 31. After the rotating portions of the rollstand assembly 27 are rotated through the first predetermined angle by the rotating drive apparatus 31, the reciprocating drive apparatus 29 begins moving the longitudinally movable portions of the rollstand assembly 27 through the smoothing stroke such that the rollstand sled 75 is moved toward the forward end plate 41 until the end of the smoothing stroke is reached after the point at which the points 99 at the largest part of the tapered grooves 93, 95 of the roll dies 89, 91 oppose one another, and the relief pockets or transition areas 102 of the grooves oppose one another and the workpiece is out of contact with the grooves, or only loosely held by the grooves.

At the end of the smoothing stroke, when the workpiece is temporarily out of contact with the tapered grooves 93, 95, the workpiece is again incrementally advanced a predetermined distance by the feed carriage assembly, through either the same distance as before or any other desired distance. At substantially the same time, the rotating portions of the rollstand assembly 27 are rotated around the workpiece through a second predetermined angle by the rotating drive apparatus 31. The mandrel is held stationary during the advancement of the workpiece, so that the end of the mandrel is always substantially at the point where the reduction stroke ends and the smoothing stroke begins.

Subsequent reduction strokes and smoothing strokes continue in substantially the same fashion. At the ends of the reduction strokes and the smoothing strokes, the relief pockets or transition areas 102 define the nip 97 and the workpiece is out of contact with the grooves 93, 95. When the workpiece is out of contact with the grooves 93, 95 at the end of the reduction and smoothing strokes, the rotating portions of the rollstand assembly 27 are rotated in a counter-clockwise or a clockwise direction around the workpiece and the workpiece is incrementally advanced by the feed carriage assembly 25. The rotating portions of the rollstand assembly may be rotated through different desired angles at the end of the reduction smoothing strokes, and the workpiece may be advanced different desired amounts at the end of the reduction and smoothing strokes.

When the feed carriage assembly 25 is no longer able to advance a workpiece because the workpiece clamp 153 is in its forward-most position, the rocker mill 21 is stopped, the workpiece is released from the workpiece clamp, and the workpiece clamp drive 161 returns the workpiece clamp to its rear-most position. The mandrel is unclamped from the forward-most mandrel clamp 151 and clamped in the mandrel clamp 151' near the forward block 33 so that it is held stationary. A new workpiece is slid over the mandrel and installed in the bore 159 of the workpiece clamp 153 as the mandrel is released from the mandrel clamp 151' near the forward block 33 and reclamped in the forward-most mandrel clamp 151. The new workpiece pushes the old workpiece as the workpiece clamp 153 is incrementally advanced by the workpiece clamp drive 161. The old workpiece is prevented from rotating by the holding means 177.

In a method according to the invention for reducing the diameter of a cylindrical workpiece, a workpiece is fed by the feed carriage assembly 25 between the roll dies 89, 91 having tapered circumferential grooves 93,

95 defining a nip 97 for receiving the workpiece. The workpiece is held in a position relative to the roll dies 89, 91 by a workpiece clamp 153 of the feed carriage assembly 25 that is incrementally advanced by the driving means 161. The roll dies 89, 91 are longitudinally reciprocated, by the reciprocating drive apparatus 29, relative to the, workpiece along a predetermined distance through a reduction stroke and a smoothing stroke. The roll dies 89, 91 are intermittently rotated by the rotating drive apparatus 31 such that rotation occurs through a predetermined angle around the longitudinal axis of the workpiece. As desired for a specific application, the roll dies 89, 91 are rotated when the workpiece is not in contact with the grooves, generally at the points at the end of the smoothing stroke, at the end of the reduction stroke, or at the end of both the reduction stroke and the end of the smoothing stroke when the nip 97 is defined by the relief pockets or transition portions 102 of the grooves 93, 95. The roll dies 89, 91 are rotated around the longitudinal axis of the workpiece in a clockwise, a counter-clockwise, or both a clockwise and a counter-clockwise direction.

The workpiece is advanced by the workpiece clamp drive 161 advancing the workpiece clamp 153 which holds a workpiece. The held workpiece advances any earlier workpieces that are already in the rocker mill 21 as the leading end of the held workpiece is advanced and contacts the trailing end of the earlier workpiece. The workpieces are advanced when the workpieces in the nip 97 are not in contact with the tapered grooves 93, 95, such as at the end of the reduction stroke, the end of the smoothing stroke, or at both the end of the reduction stroke and the end of the smoothing stroke.

The rocker mill 21 has thus far been described with reference to a feed carriage assembly 25 that incrementally advances a workpiece through the rocker mill by pushing it from the rear of the workpiece. As seen with reference to FIGS. 8, 9, and 10A–10C, it is also possible to incrementally advance the workpiece by pulling the workpiece through a rocker mill 21'. Unlike the rocker mill 21 in which the feed carriage 25 pushes the workpiece through the nip 97 from the rear of the workpiece, the feed carriage assembly 25' of the rocker mill 21', in addition to being adapted to incrementally advance the workpiece at the end of either or both the reduction and smoothing strokes, is preferably adapted to accommodate the irregular advancement of the forward end of the workpiece that occurs during reduction strokes to prevent buckling of the workpiece.

Figure 10A:
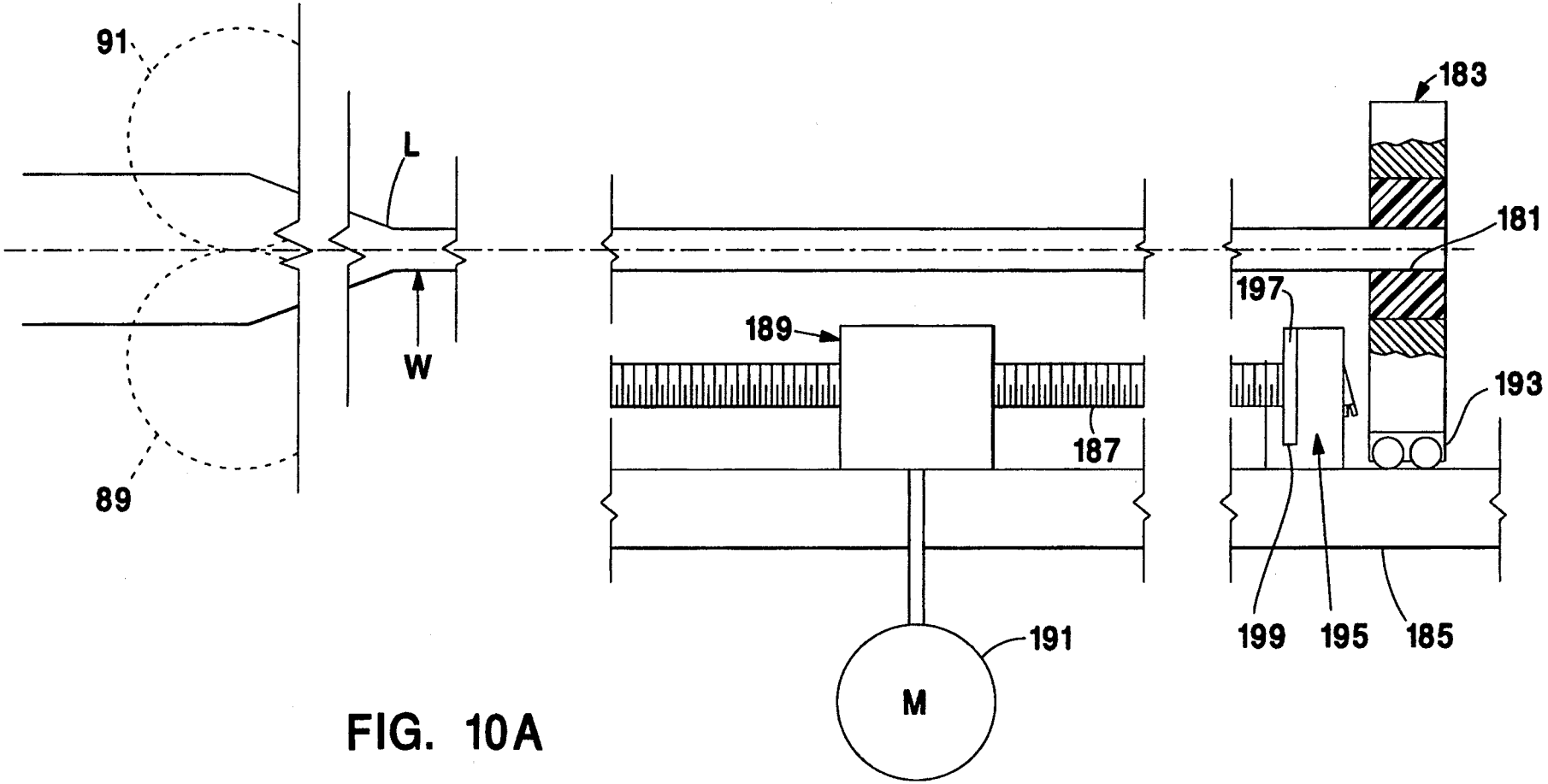
FIGS. 10A–10C are partial cross sectional, schematic views of pull-type feed carriages according to embodiments of the present invention.

As seen, for example, with reference to FIG. 10A, during pulling of the workpiece by the feed carriage 25' of the rocker mill 21', a forward portion of the workpiece is held in a passage 181 of a clamp 183 which is incrementally advanced along a slide 185 to pull the workpiece. The clamp 183 is preferably incrementally advanced along the slide 185 by being contacted by a leading end of a screw 187. The leading end of the screw 187 is incrementally advanced by a drive means 189, preferably including an electric motor 191, that advances the leading end of the screw a desired distance at the end of the reduction and/or smoothing strokes. The drive means 189 preferably includes a worm gear (not shown) that is turned by the motor 191 to advance the screw 187.

During the reduction stroke, when the forward end of the workpiece is squeezed forward some generally nearly constant, but slightly irregular, amount, the forward end of the workpiece must be allowed to advance to prevent buckling Accordingly, the forward end of the workpiece must be allowed to advance relative to the passage 181 in the clamp 183, or the clamp 183 must be adapted to advance with the forward end of the workpiece, or, preferably, the workpiece is allowed to advance relative to the passage in the clamp and the clamp is adapted to advance with the forward end of the workpiece.

FIG. 10A shows the workpiece W secured in a passage 181 of a clamp 183 that is adapted to move along the slide 185 with a minimum of resistance due to bearings 193 which support the clamp relative to the slide. The clamp 183 is preferably of sufficiently low mass that, when the forward end of the workpiece W is advanced during the reduction stroke, the clamp slides with the forward end of the workpiece. When the clamp 183 slides in the slide 185 with the forward end of the workpiece W during the reduction stroke, the clamp and the leading end of the screw 187 lose contact.

So that the screw 187 is in position to advance the clamp 183 at the end of the reduction and/or smoothing strokes, a switch mechanism 195 is disposed at the leading end of the screw to contact the clamp when the screw is in position to advance the clamp. When the clamp 183 is advanced, by movement of the forward portion of the workpiece, to a position in which the leading end of the screw 187 does not contact the clamp, the switch 195 closes a contact so that the electric motor 191 operates to move the screw to a point at which the leading end of the screw does contact the clamp, and the contact in the switch is opened to stop the electric motor. At the end of the reduction and/or smoothing strokes, the electric motor 191 is powered through another circuit to advance the screw 187 and the clamp 185 desired amounts. The switch mechanism 195 is preferably advanced and withdrawn with the leading end of the screw 187, but does not rotate with the screw, to facilitate forming electrical connections with the contacts of the switch mechanism by conductors such as wires. A flange 197 mounted on the leading end of the screw 187 is disposed in a flange receiving recess 199 on the switch mechanism 195 so that the leading end of the screw and the switch mechanism are advanced and withdrawn together, but the switch mechanism does not rotate with the leading end of the screw.

The passage 181 in the clamp 183 in which the workpiece is held may also be adapted to permit the forward end of the workpiece to advance irregularly during the reduction stroke. As seen in FIG. 10A, the passage 181 is formed of in a material such as compressible rubber or foamed plastic material, mounted in the clamp 183, that holds the workpiece W with sufficient friction to prevent rotation of the workpiece when the rotating portions of the rocker mill 21' rotate around the workpiece, while also permitting the workpiece to slide longitudinally relative to the clamp when it is advanced during the reduction stroke. Thus, the feed carriage 25' permits the forward end of the workpiece W to advance relative to the clamp 183 as well as permitting the clamp to advance relative to the rocker mill 21' to accommodate irregular advancement of the forward end of the workpiece.

Figure 10B:
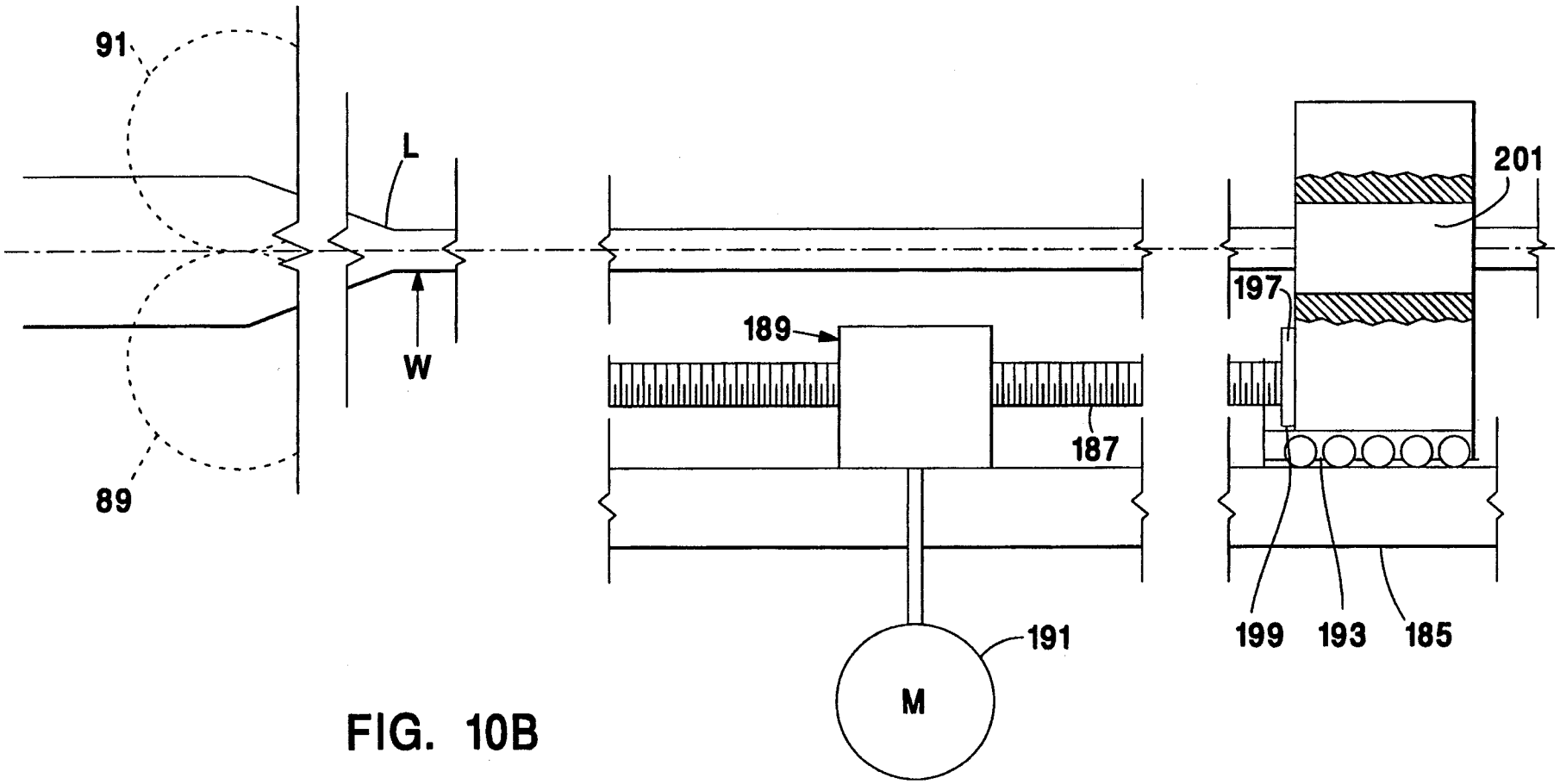

As seen in FIG. 10B, the workpiece W may be secured in the passage 181 by means that positively grips the workpiece when the workpiece is being pulled at the end of the reduction and/or smoothing strokes and releases the workpiece during at least the reduction stroke to permit the forward end of the workpiece to advance irregular amounts. The drive means 189 preferably advances the clamp 183 in only the forward direction, as described above, and return to a starting point when a new workpiece is installed for reduction. However, if the workpiece W is released in the passage 181 during one or both of the reduction or smoothing strokes, the clamp 183 may, if desired, be reciprocated to return to a starting point during each reduction and/or smoothing stroke.

In the embodiment shown in FIG. 10B, the flange 197 is mounted at the leading end of the screw 187 and is positioned in a flange-receiving recess 199 on the clamp 183 so that, when the screw is advanced or withdrawn by the drive means 189, the clamp follows the leading end of the screw. When the screw 187 is advanced by the drive means 189 to advance the clamp 183 and the workpiece passing through the passage 181, means 201, disposed in the passage 181, automatically clamps the periphery of the workpiece with sufficient force so that the workpiece is advanced with the clamp but is not damaged by the clamping means. Clamping means 201 suited for use in connection with the present invention are of the type typically used to grip workpieces so that the workpiece can be turned and thereafter release the workpiece so that the workpiece can be advanced. The drive means 189 and the clamping means 201 are preferably controlled to operate at appropriate times by the synchronizing means 145.

Figure 10C:
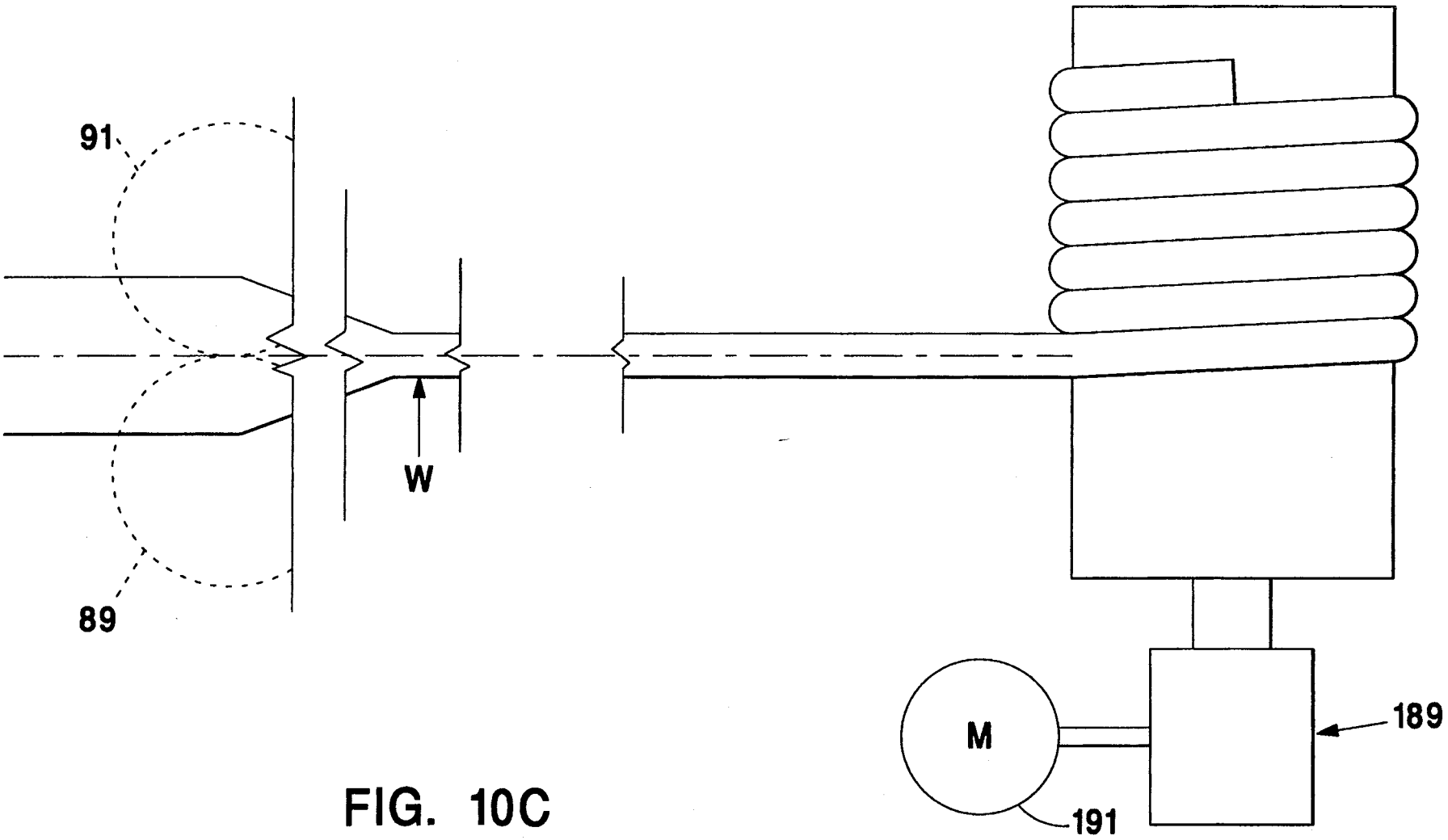

Yet another pull-type feed carriage 25' is shown in FIG. 10C. Where the reduced diameter workpiece W is of the type adapted to be coiled on a spool 205, the spool is driven intermittently to advance the workpiece. The drive means 189 turns the spool 205 through a desired angle at the end of the reduction and/or smoothing strokes to advance the workpiece W a desired amount. The drive means 189 preferably includes a clutch (not shown) that engages when the spool 205 is turned the desired amount and that disengages to permit the spool to turn freely to accommodate irregular advancement of the workpiece W during reduction.

Figure 8:
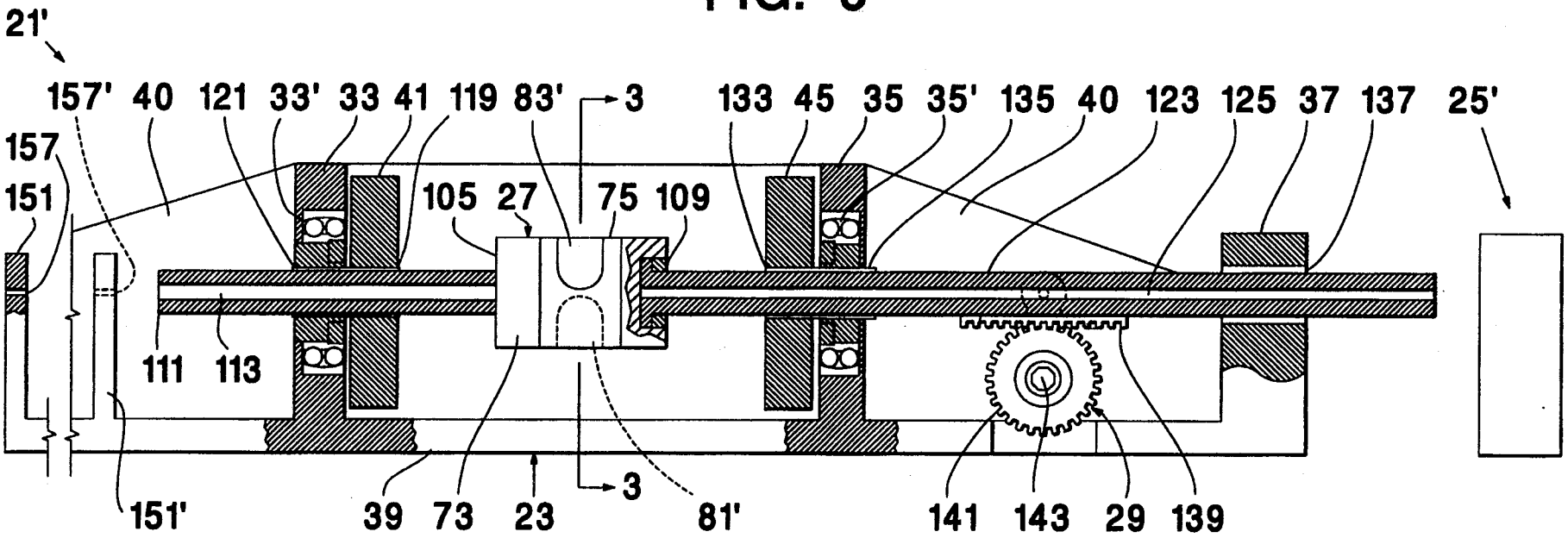
FIG. 8 is a side, partial cross sectional, schematic view of a rocker mill including a pull-type feed carriage according to an embodiment of the present invention.
Figure 9:
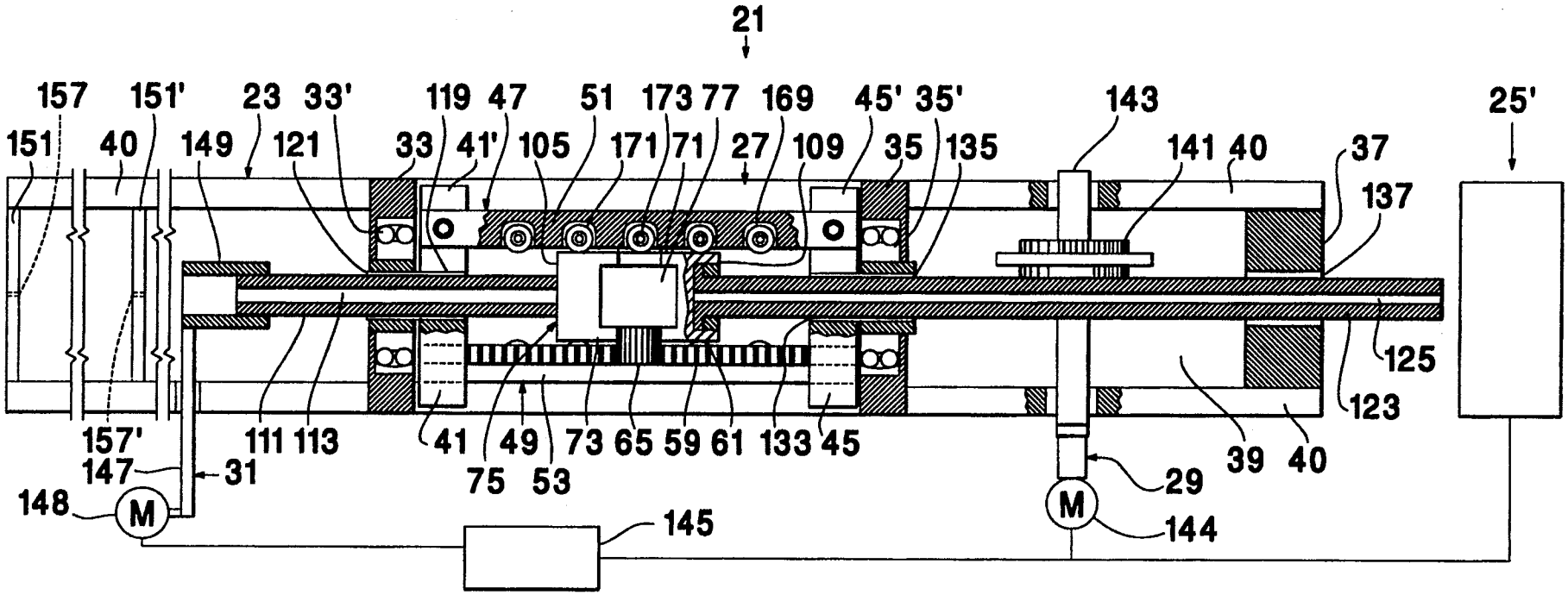
FIG. 9 is a top, partial cross sectional, schematic view of the rocker mill of FIG. 8.

As seen in FIGS. 8 and 9, in the embodiments of the rocker mill 21' including a pull-type feed carriage 25' assemblies shown in FIGS. 10A–10C, the unreduced Workpiece W is preferably installed in the rocker mill through the axial bore 125 in the con rod 123, through the nip 97 formed by the transition portions 102 of the grooves 93, 95 of the roll dies 89, 91, and out of the axial bore 113 in the guide shaft 111 and is supported in the bores 157' by the one or more mandrel clamps 151'. The axial bore 125 in the con rod 123 is larger in diameter in the rocker mill 21' than the axial bore required for the rocker mill 21 to facilitate installation of the unreduced portion of the workpiece. The workpiece is installed over the mandrel (not shown), the forward-most end of which extends, as in the rocker mill 21, to a point near the end of the reduction stroke. A length L of the workpiece W, seen, for example, in FIG. 10A, which is at least as long as the length of the reduction stroke, is preferably reduced in diameter to the desired reduction diameter of the finished workpiece by means other than the rocker mill 21', such as by swaging, and is positioned along the course of the roll dies 89, 91. Although the reduced diameter length L of the workpiece W must generally be subsequently scrapped, beginning with the reduced diameter length facilitates start-up of the rocking operation as, otherwise, it may be difficult for the roll dies 89, 91 to move forward and turn to form a smaller diameter nip 97 along the unreduced diameter workpiece.

Although the present invention has been described in connection with a preferred embodiment thereof, it will be appreciated by those skilled in the art that additions, deletions, substitutions, and modifications not specifically described may be made without departing from the spirit and scope of the invention as defined in the appended claims.

What is claimed is:

1. An apparatus for reducing the diameter of a cylindrical workpiece, comprising:

a frame;

an assembly including means for supporting a pair of roll dies rotatably about their axes, the roll dies having tapered circumferential grooves defining a nip for receiving a workpiece;

means for supporting the assembly relative to the frame, the assembly supporting means permitting the assembly to rotate about the longitudinal axis of the workpiece and permitting the assembly to move longitudinally relative to the frame;

means for longitudinally reciprocating the assembly including the roll dies relative to the frame through a predetermined distance through a reduction stroke and a smoothing stroke; and intermittent rotating means for rotating the roll dies around the longitudinal axis of the workpiece such that rotation occurs through a predetermined angle.

2. The apparatus as set forth in claim 1, wherein a portion of the assembly supporting means is axially rotatable relative to the roll dies.

3. The apparatus as set forth in claim 1, wherein the intermittent rotating means rotates the roll dies about the longitudinal axis of the workpiece at the end of the smoothing stroke.

4. The apparatus as set forth in claim 1, wherein the intermittent rotating means rotates the roll dies about the longitudinal axis of the workpiece at the end of the reduction stroke.

5. The apparatus as set forth in claim 1, wherein the intermittent rotating means rotates the roll dies about the longitudinal axis of the workpiece at the end of the smoothing stroke and at the end of the reduction stroke.

6. The apparatus as set forth in claim 1, wherein the intermittent rotating means is adapted to rotate the roll dies about the longitudinal axis of the workpiece in a clockwise and a counterclockwise direction.

7. The apparatus as set forth in claim 6, wherein the intermittent rotating means is adapted to rotate the roll dies clockwise about the longitudinal axis of the workpiece at the end of a reduction stroke.

8. The apparatus as set forth in claim 7, wherein the intermittent rotating means is adapted to rotate the roll dies clockwise about the longitudinal axis of the workpiece at the end of a smoothing stroke.

9. The apparatus as set forth in claim 8, wherein the intermittent rotating means is adapted to rotate the roll dies counterclockwise about the longitudinal axis of the workpiece at the end of another smoothing stroke.

10. The apparatus as set forth in claim 7, wherein the intermittent rotating means is adapted to rotate the roll dies counterclockwise about the longitudinal axis of the workpiece at the end of another reduction stroke.

11. The apparatus as set forth in claim 1, further comprising means for incrementally advancing a workpiece through the nip.

12. The apparatus as set forth in claim 11, further comprising means for restraining the workpiece against rotation about its axis.

13. The apparatus as set forth in claim 11, wherein the incremental advancing means advances the workpiece at the end of the reduction stroke.

14. The apparatus as set forth in claim 11, wherein the incremental advancing means advances the workpiece at the end of the smoothing stroke.

15. The apparatus as set forth in claim 11, wherein the incremental advancing means advances the workpiece at the end of the reduction stroke and at the end of the smoothing stroke.

16. The apparatus as set forth in claim 11, wherein the incremental advancing means includes means for pushing a workpiece through the nip.

17. The apparatus as set forth in claim 11, wherein the incremental advancing means includes means for pulling a workpiece through the nip.

18. The apparatus as set forth in claim 17, wherein the means for pulling the workpiece through the nip includes means for accommodating irregular advancement of a forward portion of the workpiece due to reduction in diameter of the workpiece.

19. The apparatus as set forth in claim 18, wherein the accommodating means includes a workpiece holder that advances due to advancement of the workpiece due to reduction in diameter of the workpiece.

20. The apparatus as set forth in claim 18, wherein the accommodating means includes a workpiece holder that holds the workpiece sufficiently tightly to prevent rotation of the workpiece relative to holder while allowing the forward portion of the workpiece to advance relative to the holder due to irregular advancement of the workpiece due to reduction in diameter of the workpiece.

21. The apparatus as set forth in claim 18, wherein the accommodating means includes a workpiece holder that alternately grips the workpiece during incremental advancement and releases the workpiece during the reduction stroke.

22. The apparatus as set forth in claim 21, wherein the workpiece holder is reciprocated from an advanced position to a starting position during the reduction stroke.

23. The apparatus as set forth in claim 18, wherein the accommodating means includes a workpiece holder that alternately grips the workpiece during incremental advancement and releases the workpiece during the smoothing stroke.

24. The apparatus as set forth in claim 23, wherein the workpiece holder is reciprocated from an advanced position to a starting position during the smoothing stroke.

25. The apparatus as set forth in claim 17, wherein the means for pulling the workpiece through the nip include means for coiling the reduced diameter workpiece.

26. A method for reducing the diameter of a cylindrical workpiece, comprising the steps of:

feeding a workpiece between a pair of roll dies having tapered circumferential grooves defining a nip for receiving the workpiece;

longitudinally reciprocating the roll dies relative to the workpiece through a predetermined longitudinal distance through a reduction stroke and a smoothing stroke such that the roll dies rotate about roll die axes;

intermittently rotating the roll dies around the longitudinal axis of the workpiece such that rotation occurs through a predetermined angle.

27. The method as set forth in claim 26, wherein the roll dies are rotated at the end of the smoothing stroke.

28. The method as set forth in claim 26, wherein the roll dies are rotated at the end of the reduction stroke.

29. The method as set forth in claim 26, wherein the roll dies are rotated at the end of the smoothing stroke and at the end of the reduction stroke.

30. The method as set forth in claim 26, wherein the roll dies are rotated in a clockwise and a counter-clockwise direction.

31. The method as set forth in claim 26, comprising the further step of incrementally advancing the workpiece through the nip.

32. The method as set forth in claim 31, wherein the workpiece is incrementally advanced at the end of the reduction stroke.

33. The method as set forth in claim 31, wherein the workpiece is incrementally advanced at the end of the smoothing stroke.

34. The method as set forth in claim 31, wherein the workpiece is incrementally advanced at the end of the reduction stroke and at the end of the smoothing stroke.

35. The method as set forth in claim 31, including incrementally advancing the workpiece by pushing the workpiece.

36. The method as set forth in claim 31, including incrementally advancing the workpiece by pulling the workpiece.

37. The method as set forth in claim 26, comprising the further step of restraining angular rotation of the workpiece.

38. A rotatable rollstand assembly for a rocker mill, comprising:

a die assembly including axle means for rotatably supporting a pair of roll dies having tapered circumferential grooves defining a nip for receiving a workpiece and a pair of gears; and means, including a rack assembly, for supporting the die assembly relative to a pair of racks for engaging with the pair of gears such that longitudinal movement of the die assembly relative to the racks causes the roll dies to rotate in opposite directions, at least portions of the supporting means being adapted to be rotatably mounted such that rotation of the supporting means causes rotation of the roll dies about a longitudinal axis passing through the nip.

39. The rotatable rollstand assembly as set forth in claim 38, wherein the supporting means include a member adapted to be driven by a rotating means for rotating the roll dies about the longitudinal axis.

40. The rotatable rollstand assembly as set forth in claim 38, wherein the supporting means include a member adapted to be driven by a reciprocating means for reciprocating the die assembly longitudinally relative to the rack assembly.

41. The rotatable rollstand assembly as set forth in claim 40, wherein the member is adapted to rotate relative to the supporting means.

42. The rotatable rollstand assembly as set forth in claim 41, wherein the supporting means include a second member adapted to be driven by a rotating means for rotating the roll dies about the longitudinal axis.

43. An apparatus for reducing the diameter of a cylindrical workpiece, comprising:

means for feeding a workpiece between a pair of roll dies having tapered circumferential grooves defining a nip for receiving the workpiece:

means for longitudinally reciprocating the roll dies relative to the workpiece through a predetermined longitudinal distance through a reduction stroke and a smoothing stroke such that the roll dies rotate about roll die axes;

means for intermittently rotating the roll dies around the longitudinal axis of the workpiece such that rotation occurs through a predetermined angle.

44. The apparatus as set forth in claim 43, further including a stationary mandrel adapted to support interior walls of the workpiece.

* * * * *